US011933315B2

(12) United States Patent
Yamazaki

(10) Patent No.: US 11,933,315 B2
(45) Date of Patent: Mar. 19, 2024

(54) AXIAL FAN

(71) Applicant: SANYO DENKI CO., LTD., Tokyo (JP)

(72) Inventor: Yoshihisa Yamazaki, Tokyo (JP)

(73) Assignee: SANYO DENKI CO., LTD., Tokyo (JP)

( * ) Notice: Subject to any disclaimer, the term of this patent is extended or adjusted under 35 U.S.C. 154(b) by 140 days.

(21) Appl. No.: 17/844,385

(22) Filed: Jun. 20, 2022

(65) Prior Publication Data

US 2023/0024002 A1 Jan. 26, 2023

(30) Foreign Application Priority Data

Jul. 20, 2021 (JP) ..... 2021-119448

(51) Int. Cl.
*F04D 29/38* (2006.01)
*F04D 29/32* (2006.01)

(52) U.S. Cl.
CPC ..... *F04D 29/384* (2013.01); *F04D 29/325* (2013.01)

(58) Field of Classification Search
CPC ..... F04D 29/325; F04D 29/384
USPC ..... 416/226 R
See application file for complete search history.

(56) References Cited

U.S. PATENT DOCUMENTS 5,616,004 A * 4/1997 Alizadeh ..... F04D 29/384 416/169 A
6,595,744 B2 * 7/2003 Van Houten ..... F04D 29/582 415/173.1
8,128,338 B2 * 3/2012 Suzuki ..... F03D 1/0608 415/4.5
9,556,881 B2 * 1/2017 Seiji ..... F04D 29/384
9,726,190 B2 8/2017 Kumon et al.
10,052,931 B2 * 8/2018 Nakashima ..... F04D 25/166
(Continued)

FOREIGN PATENT DOCUMENTS

JP 5905985 B1 4/2016
WO 2013/154100 A1 10/2013
WO 2019/150567 A1 8/2019

OTHER PUBLICATIONS

Extended European Search Report (EESR) dated Dec. 12, 2022 for European Patent Application No. 22179862.2.

*Primary Examiner* — Woody A Lee, Jr.
*Assistant Examiner* — Justin A Pruitt
(74) *Attorney, Agent, or Firm* — RANKIN, HILL & CLARK LLP

(57) ABSTRACT

Provided is an axial fan including: a motor; and an impeller for sending air in an air-blowing direction, wherein the impeller includes: a base covering the motor; and plural blades mounted on an outer peripheral surface of the base, a wind receiving surface of the blade includes a concave portion recessed toward a downstream side in the air-blowing direction, a bottom point of the concave portion is located downstream in the air-blowing direction relative to a first imaginary line perpendicular to the air-blowing direction, the first imaginary line being drawn in a radial direction from a joint position of the blade where the wind receiving surface and the outer peripheral surface of the base merge, and the bottom point is displaced from inward to outward in the radial direction, in going from upstream to downstream in the air-blowing direction, until reaching a radially central part of the blade.

4 Claims, 7 Drawing Sheets

(56) References Cited

U.S. PATENT DOCUMENTS

| | | | |
|---|---|---|---|
| 10,544,797 | B2 | 1/2020 | Kumon et al. |
| 2010/0266428 | A1 | 10/2010 | Nakagawa et al. |
| 2015/0125307 | A1 | 5/2015 | Kumon et al. |
| 2017/0051747 | A1 | 2/2017 | Nakamura et al. |
| 2017/0292529 | A1 | 10/2017 | Kumon et al. |
| 2020/0408225 | A1 | 12/2020 | Arai et al. |

* cited by examiner

AXIAL FAN

CROSS-REFERENCE TO RELATED APPLICATION

This application is based on Japanese Patent Application No. 2021-119448 filed with the Japan Patent Office on Jul. 20, 2021, the entire content of which is hereby incorporated by reference.

BACKGROUND

1. Technical Field

The present disclosure relates to an axial fan.

2. Related Art

Japanese Patent No. 5905985 discloses an axial blower characterized in that the power consumption is reduced while the cooling performance is maintained.

SUMMARY

An axial fan according to the present embodiment includes: a motor; an impeller configured to be rotated by the motor and send air in an air-blowing direction; and a casing including a wind tunnel along the air-blowing direction. The impeller includes: a cup-shaped base covering the motor; and a plurality of blades mounted on an outer peripheral surface of the base. The base includes an underside portion located upstream in the air-blowing direction. An outer peripheral edge of the underside portion is chamfered as viewed in a cross section of the impeller along the air-blowing direction. A wind receiving surface of the blade that is located upstream in the air-blowing direction includes a concave portion recessed toward a downstream side in the air-blowing direction. A bottom point of the concave portion of the wind receiving surface is located downstream in the air-blowing direction relative to a first imaginary line perpendicular to the air-blowing direction, the first imaginary line being drawn in a radial direction from a joint position of the blade where the wind receiving surface of the blade and the outer peripheral surface of the base merge. The bottom point is displaced from inward to outward in the radial direction, in going from upstream to downstream in the air-blowing direction, until reaching a radially central part of the blade.

DETAILED DESCRIPTION

Figure 1:
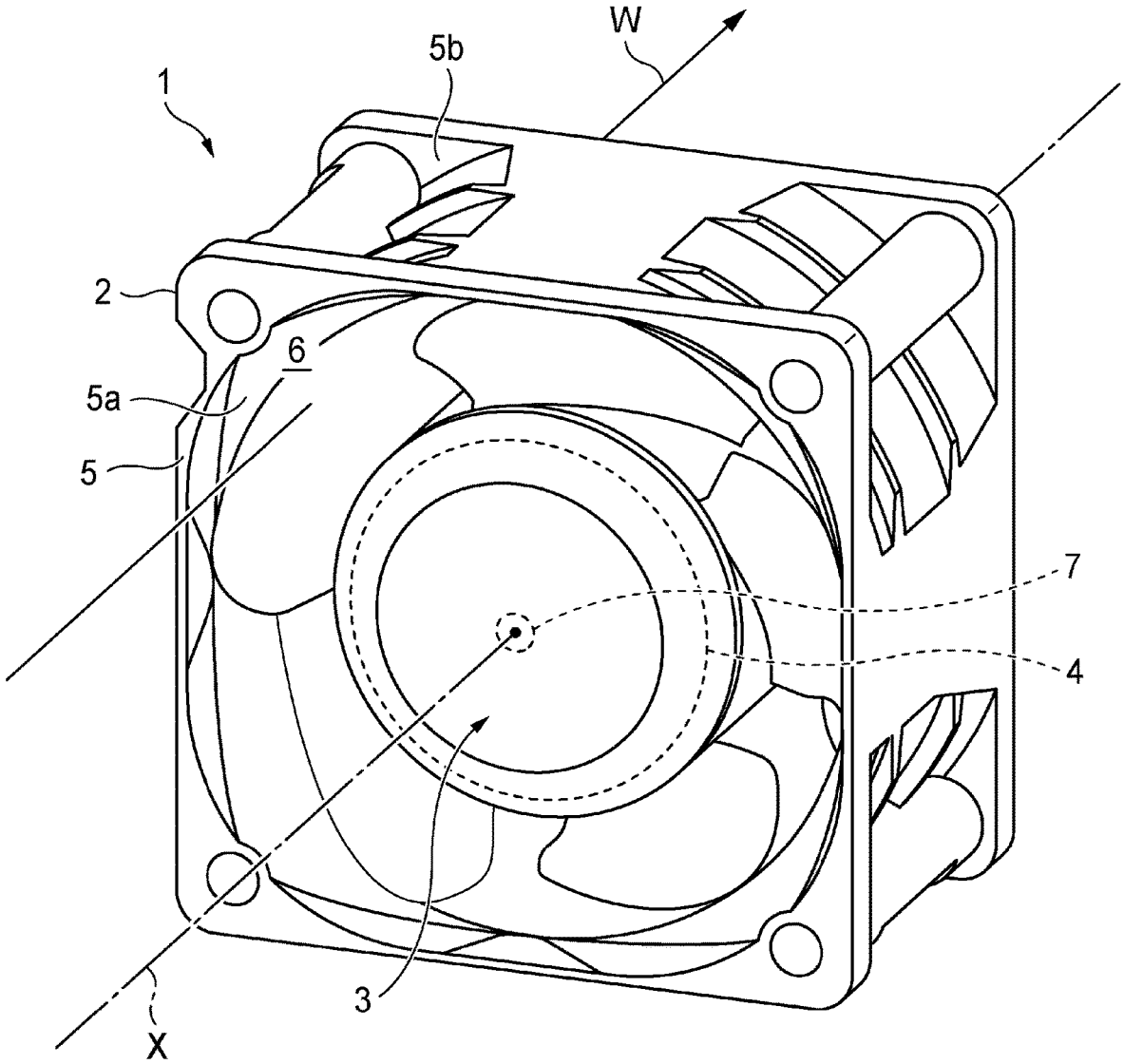
FIG. 1 is a perspective view of an axial fan according to the embodiment.

In the following detailed description, for purpose of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to the axial blower disclosed in Japanese Patent No. 5905985, blades are mounted on a hub of an impeller. The mounting angle of an inner-diameter-side portion of, the mounting angle of an outer-diameter-side portion of, and the mounting angle of an intermediate portion of the blade are each set at a respective predetermined mounting angle. As a result, the workload of the impeller per power consumed increases. Moreover, according to the axial blower, a curved cutout shape is formed at a rear edge of the blade. Among a chord of the inner-diameter-side portion of, a chord of the outer-diameter-side portion of, and a chord of the intermediate portion of the blade, the chord of the intermediate portion is shorter than before. Therefore, the efficiency of rotation of the impeller increases.

In terms of the axial blower disclosed in Japanese Patent No. 5905985, the reduction of power consumption based on a change in the shape of the blade is described. However, specific contents of, for example, the uniformity and straightness of the flow of wind are not sufficiently studied. Therefore, there is room for improvement in these points.

Hence, an object of the present disclosure is to provide an axial fan that can increase the air flow rate by improving the uniformity and straightness of the flow of wind.

An axial fan according to one aspect of the present disclosure includes: a motor; an impeller configured to be rotated by the motor and send air in an air-blowing direction; and a casing including a wind tunnel along the air-blowing direction. The impeller includes: a cup-shaped base covering the motor; and a plurality of blades mounted on an outer peripheral surface of the base. The base includes an underside portion located upstream in the air-blowing direction, and an outer peripheral edge of the underside portion is chamfered as viewed in a cross section of the impeller along the air-blowing direction. A wind receiving surface of the blade that is located upstream in the air-blowing direction has a concave shape recessed toward a downstream side in the air-blowing direction. A bottom point of the concave portion of the wind receiving surface is located downstream in the air-blowing direction relative to a first imaginary line perpendicular to the air-blowing direction, the first imaginary line being drawn in a radial direction from a joint position of the blade where the wind receiving surface of the blade and the outer peripheral surface of the base merge. The bottom point is displaced from inward to outward in the radial direction, in going from upstream to downstream in the air-blowing direction, until reaching a radially central part of the blade.

According to the embodiment, it is possible to provide an axial fan that can increase the air flow rate by improving the uniformity and straightness of the flow of wind.

The embodiment is described hereinafter with reference to the drawings. Descriptions of members having the same reference numerals as members already described are omitted in the following description of the embodiment for the convenience of description. Moreover, the dimensions of each member illustrated in the drawings may be different from actual dimensions thereof for the convenience of description.

FIG. 1 is a perspective view illustrating an example of the axial fan according to the embodiment.

As illustrated in FIG. 1, an axial fan 1 includes a casing 2, an impeller 3 placed in the casing 2, and a motor 4 configured in such a manner as to rotationally drive the impeller 3. The motor 4 is housed in the impeller 3.

The casing 2 includes a tubular portion 5 having an inlet 5*a* and an outlet 5*b* for wind (air). The tubular portion 5 defines a wind tunnel 6 as an inner space thereof. The wind that is drawn in through the inlet 5*a* with the rotation of the impeller 3 is delivered in an air-blowing direction W indicated by an arrow through the wind tunnel 6, and discharged to the outside through the outlet 5*b*.

The impeller 3 is fixed to a rotating shaft 7 of the motor 4. The rotating shaft 7 is provided in a central part of the wind tunnel 6 through the wind tunnel 6. The rotating shaft 7 is provided in such a manner that a direction of an axis X thereof is along the air-blowing direction W. The impeller 3 rotates together with the rotating shaft 7 in the wind tunnel 6. Therefore, the wind is sent in the air-blowing direction W. The impeller 3 includes a cup-shaped base 10 that covers the motor 4, and a plurality of (five in the example illustrated in the drawing) blades 20 mounted on the base 10.

A motor case (illustration omitted) that fixes the motor 4 is provided downstream of the impeller 3 in the air-blowing direction. The motor case is coupled to the casing 2 via a fixed blade (illustration omitted) extending radially.

The motor 4 is configured, including a stator (illustration omitted) including a winding wound therearound, and a rotor (illustration omitted) including permanent magnets. The stator fixed to the motor case fixes the motor 4 to the casing 2 via the motor case and the fixed blade.

Figure 2:
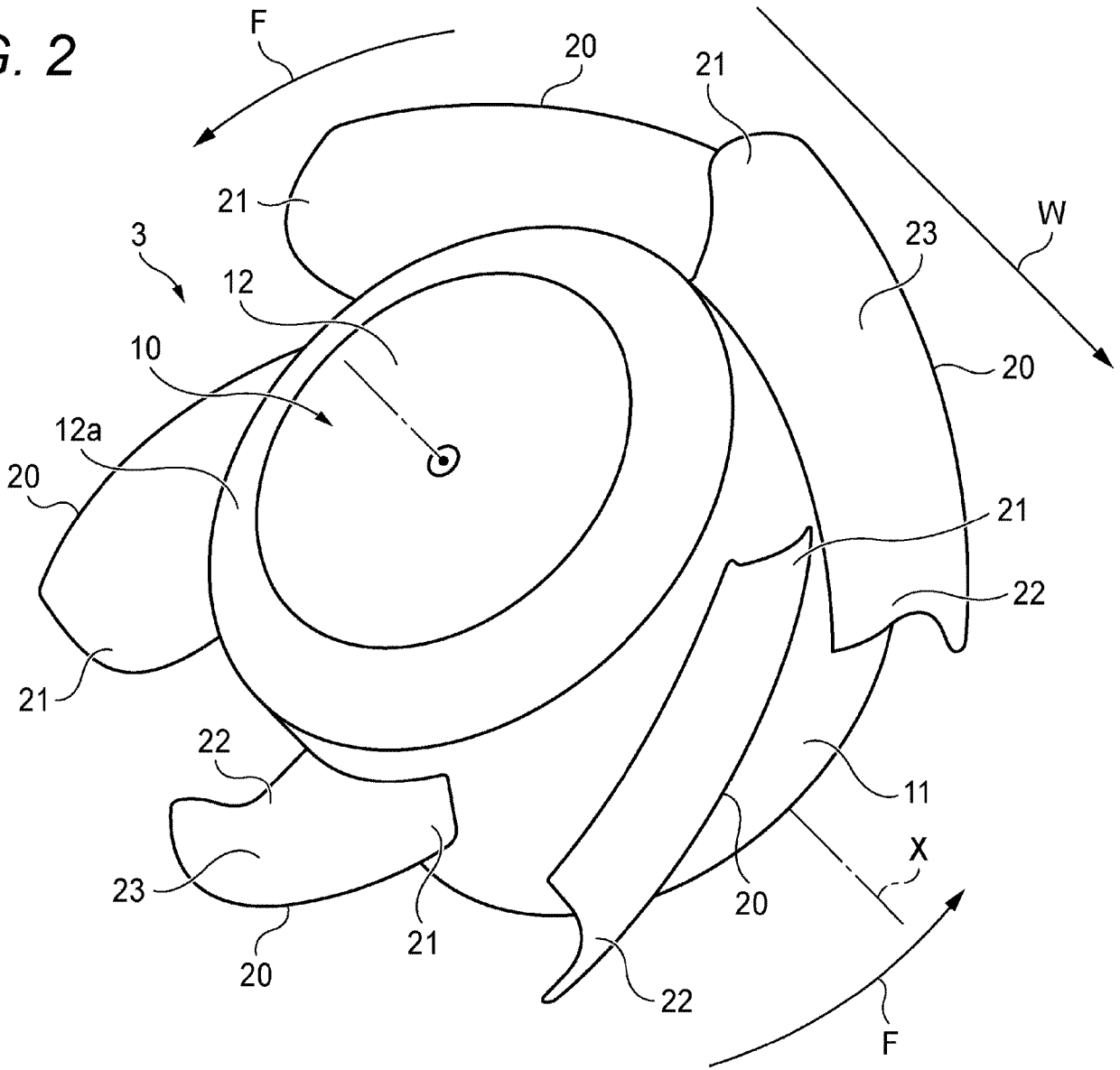
FIG. 2 is a perspective view illustrating an impeller of the axial fan.

FIG. 2 is a perspective view illustrating the impeller 3.

As illustrated in FIG. 2, the base 10 configuring the impeller 3 includes a cylindrical peripheral wall portion 11, and an underside portion 12 that blocks an opening of the peripheral wall portion 11 that is upstream in the air-blowing direction W.

The impeller 3 is mounted in such a manner that the underside portion 12 faces upstream in the air-blowing direction W. At this point in time, the cylindrical peripheral wall portion 11 is placed along a direction of the wind tunnel 6. The plurality of permanent magnets configuring the rotor of the motor 4 is fixed to an inner peripheral surface of the peripheral wall portion 11.

An outer peripheral edge 12*a* of the underside portion 12 is chamfered in a cross section of the impeller 3 along the air-blowing direction W. In the example illustrated in the drawing, the outer peripheral edge 12*a* of the underside portion 12 is chamfered in an R shape. The outer peripheral edge 12*a* may be chamfered, for example, in a C shape.

The blades 20 configuring the impeller 3 together with the base 10 are mounted on an outer peripheral surface of the peripheral wall portion 11 of the base 10. The blades 20 are provided in such a manner as to extend outward of the base 10 in the radial direction from the outer peripheral surface of the peripheral wall portion 11 and from upstream to downstream in a rotation direction F indicated by an arrow. The blades 20 rotate about the direction of the axis X along the air-blowing direction W.

Each of the blades 20 is mounted on the peripheral wall portion 11 in such a manner as to incline in a direction from upstream to downstream in the air-blowing direction W, in going from a front end portion 21 to a rear end portion 22 in the rotation direction F. Moreover, a surface of the blade 20 that is located upstream in the air-blowing direction W is defined as a "wind receiving surface." The blade 20 is formed in such a manner that a wind receiving surface 23 includes a concave portion recessed toward the downstream side in the air-blowing direction W.

Figure 3:
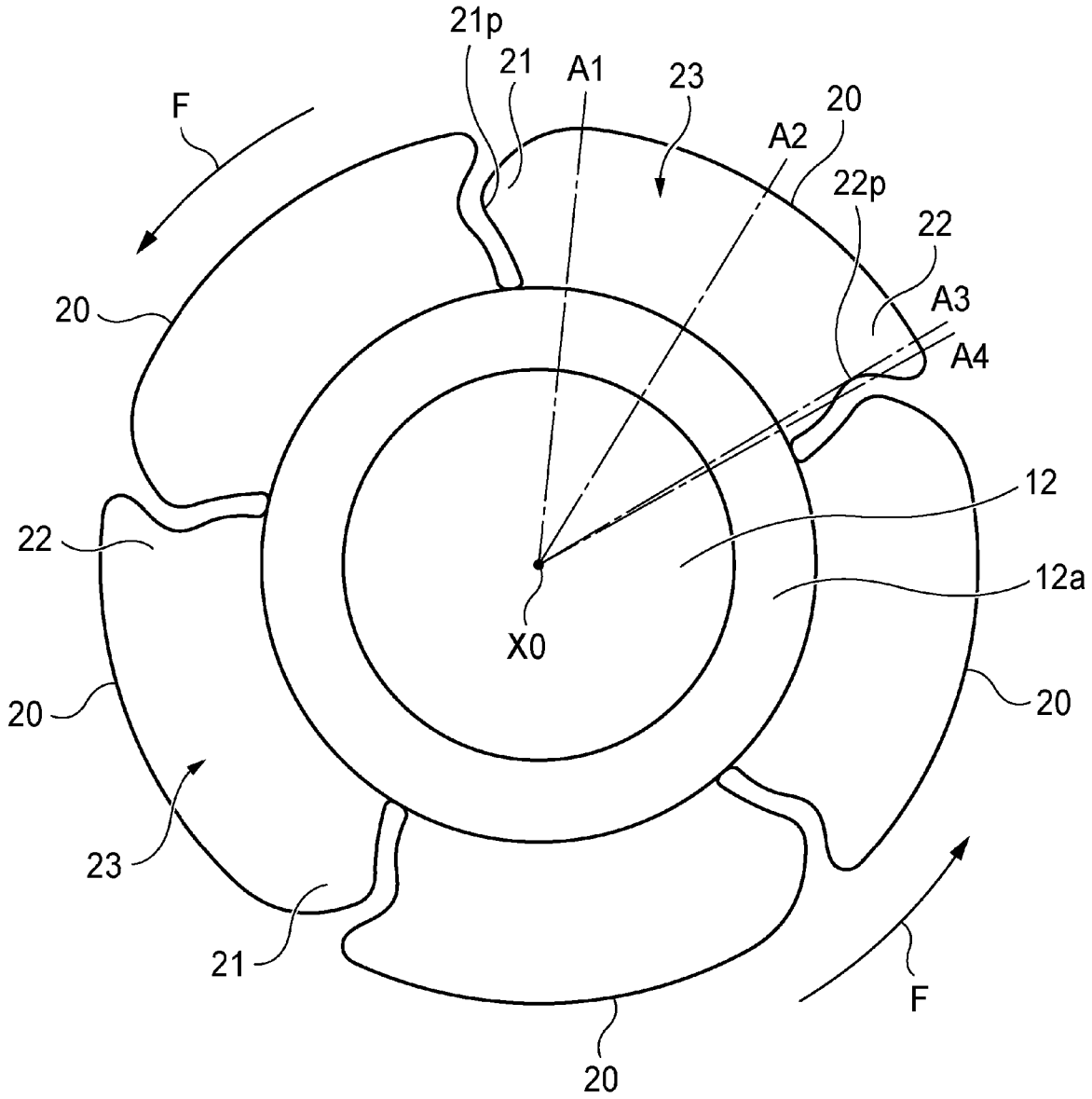
FIG. 3 is a plan view of the impeller illustrated in FIG. 2.
Figure 4:
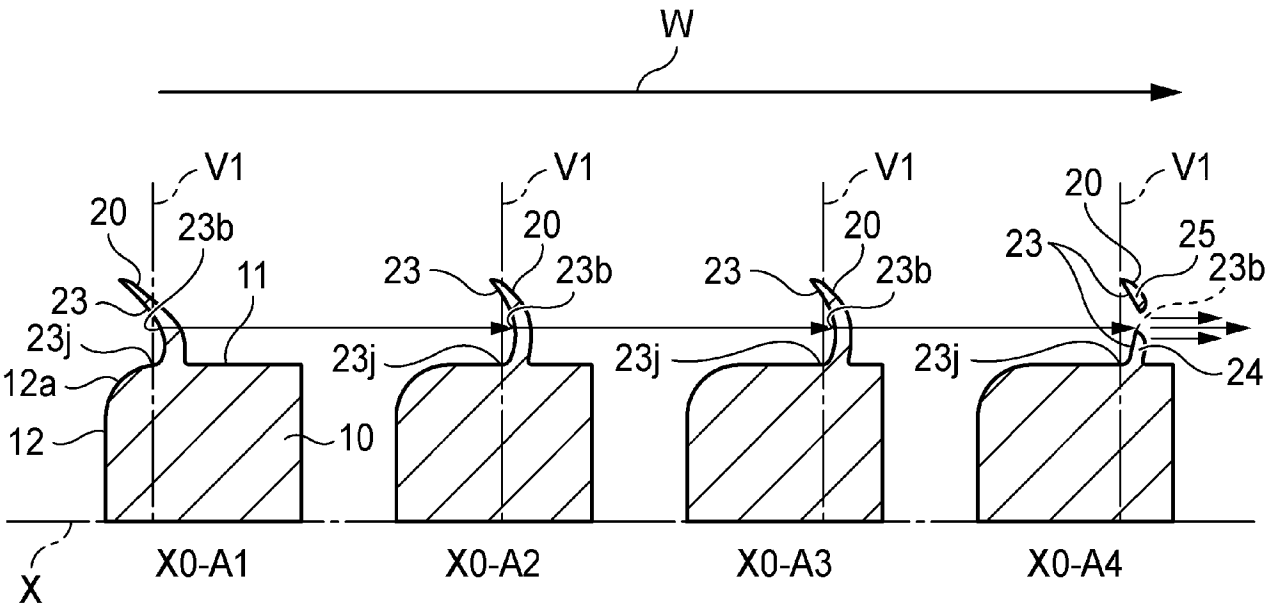
FIG. 4 is cross-sectional views taken along cutting plane lines X0-A1, X0-A2, X0-A3, and X0-A4 in FIG. 3.

FIG. 3 is a plan view of the impeller 3 illustrated in FIG. 2. FIG. 4 is cross-sectional views of the impeller 3 along the air-blowing direction W, taken along lines X0-A1, X0-A2, X0-A3, and X0-A4 in FIG. 3. The cutting plane lines X0-A1, X0-A2, X0-A3, and X0-A4 pass through the center point of the base 10 and extend in the radial direction.

In the example illustrated in the drawings, the cutting plane line X0-A1 (hereinafter referred to as, for example, "line X0-A1" as appropriate) passes through a position moved by approximately 30% of the length, in the rotation direction F, of the blade 20 toward the rear end portion 22 of the blade 20 from a forefront end portion 21*p* of the front end portion 21 of the blade 20. Line X0-A3 is a line passing through a rearmost end portion 22*p* of the rear end portion 22 of the blade 20. The rearmost end portion 22*p* is located in a radially central part of the rear end portion 22. Line X0-A2 passes through a position in almost the midpoint between line X0-A1 and line X0-A3. Line X0-A4 passes through a position that is rearward of line X0-A3 in the rotation direction F of the blade 20, at the rear end portion 22 of the blade 20.

As illustrated in FIG. 3, the five blades 20 mounted on the peripheral wall portion 11 of the base 10 are mounted in such a manner as to be spaced at regular intervals between pairs of adjacent blades 20 in the peripheral direction of the peripheral wall portion 11. Moreover, the front end portion 21 of the blade 20 is formed in a convex shape in such a manner as to protrude most at a radially central part of the front end portion 21 in the rotation direction F. The rear end portion 22 of the blade 20 is formed in a concave shape in such a manner as to be recessed most toward the rotation direction F at the radially central part of the rear end portion 22.

As illustrated in FIG. 4, the wind receiving surface 23 as viewed in cross sections along lines X0-A1, X0-A2, X0-A3, and X0-A4 (hereinafter referred to as, for example, the "wind receiving surface 23 along line X0-A1" as appropriate) is formed in such a manner as to include the concave portion recessed toward the downstream side in the air-blowing direction W. Moreover, a line that is perpendicular to the air-blowing direction W and drawn in the radial direction from a joint position 23*j* of the blade 20 where the wind receiving surface 23 of the blade 20 and the outer peripheral surface of the peripheral wall portion 11 of the base 10 merge is defined as a joint imaginary line V1. In this case, a bottom point 23*b* of the concave portion of the wind receiving surface 23 along each of lines X0-A1, X0-A2, X0-A3, and X0-A4 (hereinafter written as the "bottom point 23*b* on the wind receiving surface 23" as appropriate) is located downstream of the joint imaginary line V1 in the air-blowing direction W.

Furthermore, the position of the bottom point 23*b* on the wind receiving surface 23 is displaced from inward to outward in the radial direction, in going from upstream to downstream in the air-blowing direction W, that is to say, in going from line X0-A1 to line X0-A2 then to line X0-A3. Specifically, the bottom point 23*b* on the wind receiving surface 23 along line X0-A2 is located outward in the radial direction relative to the bottom point 23*b* on the wind receiving surface 23 along line X0-A1. Moreover, the bottom point 23*b* on the wind receiving surface 23 along line X0-A3 is located outward in the radial direction relative to the bottom point 23*b* on the wind receiving surface 23 along line X0-A2. The bottom point 23*b* on the wind receiving surface 23 along line X0-A3 passing through the rearmost end portion 22*p* of the rear end portion 22 is located in a radially central part of the blade 20.

Moreover, as mentioned above, the rear end portion 22 of the blade 20 is formed in the concave shape in such a manner as to be recessed most toward the rotation direction F at the radially central part of the rear end portion 22. Hence, as illustrated in FIGS. 3 and 4, a rear edge portion of the rear end portion 22 of the blade 20 includes a turning point (the rearmost end portion 22*p* in the example) of the concave portion, the turning point being the bottom point 23*b* on the wind receiving surface 23. The rear edge portion branches at the turning point into an inner rear edge portion 24 located on the inner side in the radial direction and an outer rear edge portion 25 located on the outer side in the radial direction.

Up to this point the examples based on lines X0-A1, X0-A2, X0-A3, and X0-A4 have been described in FIGS. 3 and 4. The wind receiving surface 23 is formed all across an area from the front end portion 21 to the rear end portion 22 of the blade 20 in such a manner as to include the concave portion recessed toward the downstream side in the air-blowing direction W. Moreover, the bottom point 23*b* on the wind receiving surface 23 is also located downstream of the joint imaginary line V1 in the air-blowing direction W all across the area.

Figure 5:
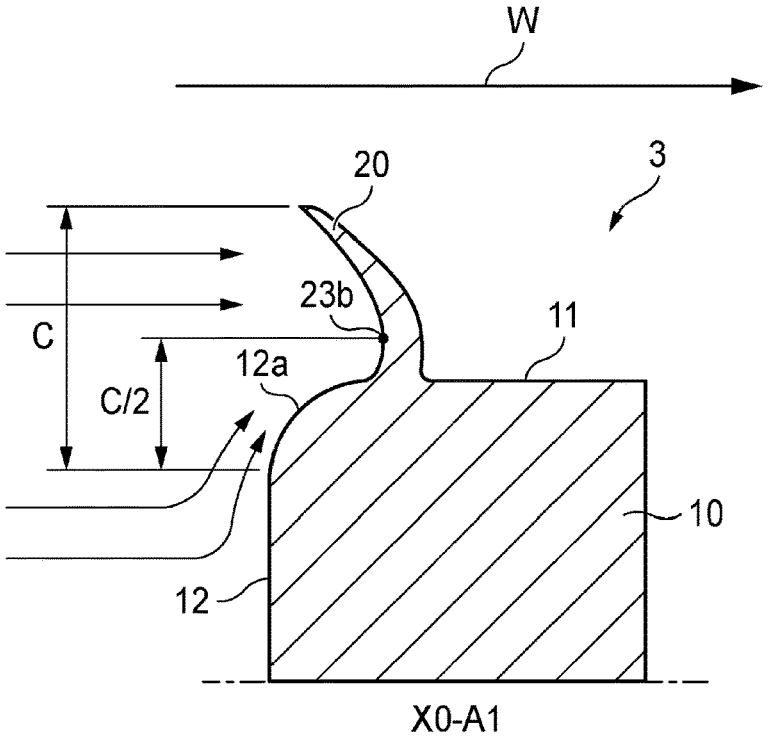
FIG. 5 is a diagram illustrating the position of a bottom point on a wind receiving surface illustrated in cross section taken along the cutting plane line X0-A1 in FIG. 3.

FIG. 5 illustrates the position of the bottom point 23*b* on the wind receiving surface 23 along line X0-A1.

As illustrated in FIG. 5, the outer peripheral edge 12*a* of the underside portion 12 of the base 10 is chamfered in the R shape. In such a case, the wind that is drawn in through the inlet 5*a* with the rotation of the impeller 3 includes the wind that hits the underside portion 12 and flows to the wind receiving surface 23 along the outer peripheral edge 12*a*, in addition to the wind that flows linearly to the wind receiving surface 23 of the blade 20 along the air-blowing direction W. Hence, considering the volume of air flowing along the outer peripheral edge 12*a*, the bottom point 23*b* on the wind receiving surface 23 is located inward in the radial direction relative to a radially outer end of the blade 20 by a half C/2 of a length C that is the sum of the lengths of the outer peripheral edge 12*a* and the blade 20 in the radial direction, at a position close to the underside portion 12 in the cross section along line X0-A1.

Figure 6:
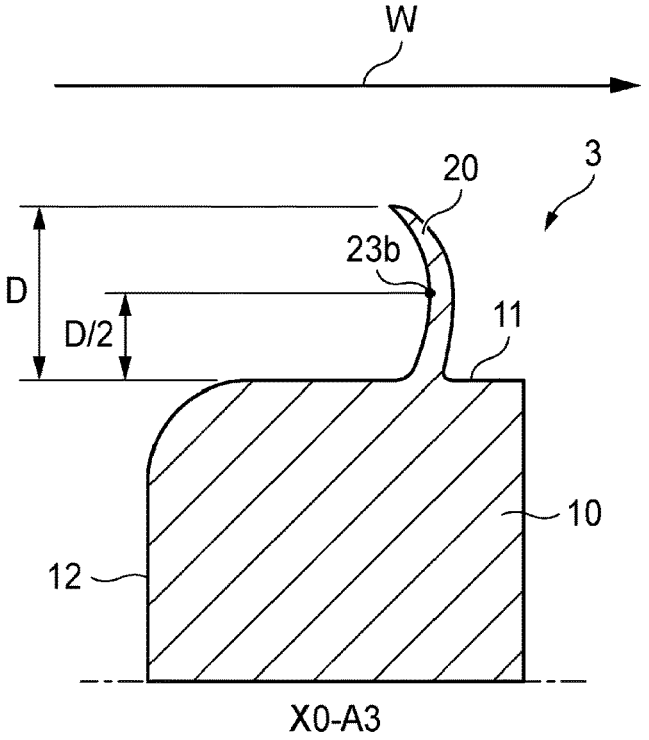
FIG. 6 is a diagram illustrating the position of the bottom point on the wind receiving surface illustrated in cross section taken along the cutting plane line X0-A3 in FIG. 3.

FIG. 6 illustrates the position of the bottom point 23*b* on the wind receiving surface 23 along line X0-A3.

As illustrated in FIG. 6, in cross section along line X0-A3, the blade 20 is placed at a position that is further downstream in the air-blowing direction W on the peripheral wall portion 11 relative to the underside portion 12 of the base 10. Moreover, line X0-A3 is located at the rear end portion 22 that is away from the front end portion 21 along the rotation direction F of the blade 20. Hence, in cross section along line X0-A3, the bottom point 23*b* on the wind receiving surface 23 is located inward in the radial direction relative to the radially outer end of the blade 20 by a half D/2 of a length D of the blade 20 in the radial direction.

Figure 7:
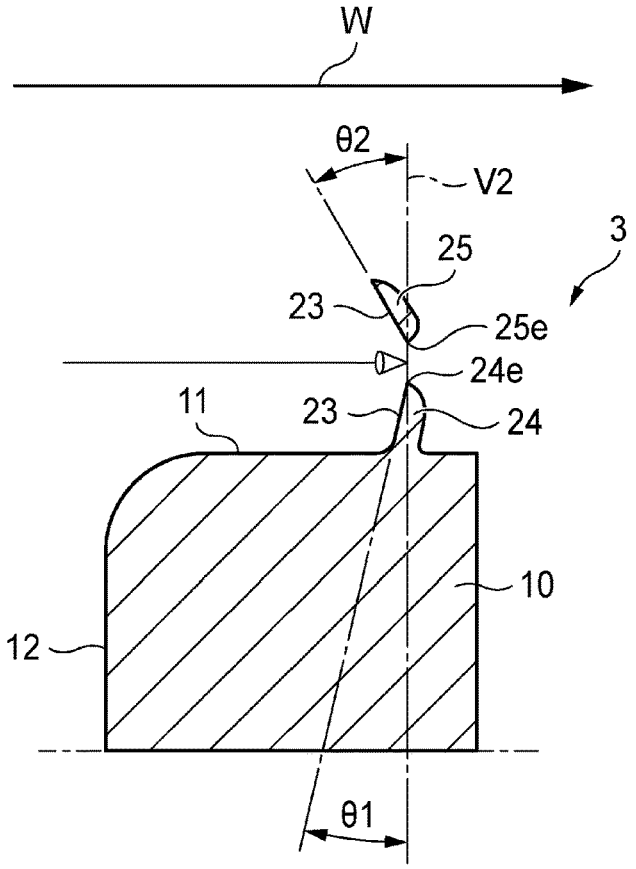
FIG. 7 is a diagram illustrating an inclination angle of an inner rear edge portion of a blade and an inclination angle of an outer rear edge portion of the blade.

FIG. 7 illustrates the inclination angles of the inner rear edge portion 24 and the outer rear edge portion 25 that are provided to the rear end portion 22 of the blade 20.

As illustrated in FIG. 7, in cross section along the air-blowing direction W, the inner rear edge portion 24 of the blade 20 inclines downstream in the air-blowing direction W, in going from the inner side to the outer side of the blade 20 in the radial direction. In other words, the inner rear edge portion 24 inclines downstream in the air-blowing direction W, in going toward the radially central part of the blade 20. In contrast, the outer rear edge portion 25 of the blade 20 inclines downstream in the air-blowing direction W, in going from the outer side to the inner side of the blade 20 in the radial direction. In other words, the outer rear edge portion 25 also inclines downstream in the air-blowing direction W, in going toward the radially central part of the blade 20.

A straight line linking a downstream end 24*e*, in the air-blowing direction W, of the wind receiving surface 23 of the inner rear edge portion 24 and a downstream end 25*e*, in the air-blowing direction W, of the wind receiving surface 23 of the outer rear edge portion 25 is defined as a lower end imaginary line V2. The inclination angle that the wind receiving surface 23 of the inner rear edge portion 24 forms with the lower end imaginary line V2 is defined as an inner inclination angle θ1. Furthermore, the inclination angle that the wind receiving surface 23 of the outer rear edge portion 25 forms with the lower end imaginary line V2 is defined as an outer inclination angle θ2.

At this point in time, the inner inclination angle θ1 and the outer inclination angle θ2 are set in such a manner as to satisfy a relationship of 0°<inner inclination angle θ1 outer inclination angle θ2<90°. When the radially outer side and inner side of the blade 20 of a normal fan are compared, the volume of air is higher on the outer side due to a difference in centrifugal force. Hence, the outer inclination angle 82 of the outer rear edge portion 25 is set greater than the inner inclination angle θ1, which enables facilitating drawing the wind on the outer side having a high volume of air to the central part of the blade 20.

In the description of the example illustrated in the drawing, the wind receiving surfaces 23 of the inner rear edge portion 24 and the outer rear edge portion 25 are formed in a flat shape. However, the wind receiving surface 23 may be formed, for example, in a concave shape. In this case, the inclination angles of chords of the concave wind receiving surfaces 23 are set as the inner inclination angle θ1 and the outer inclination angle θ2, respectively.

Figure 8:
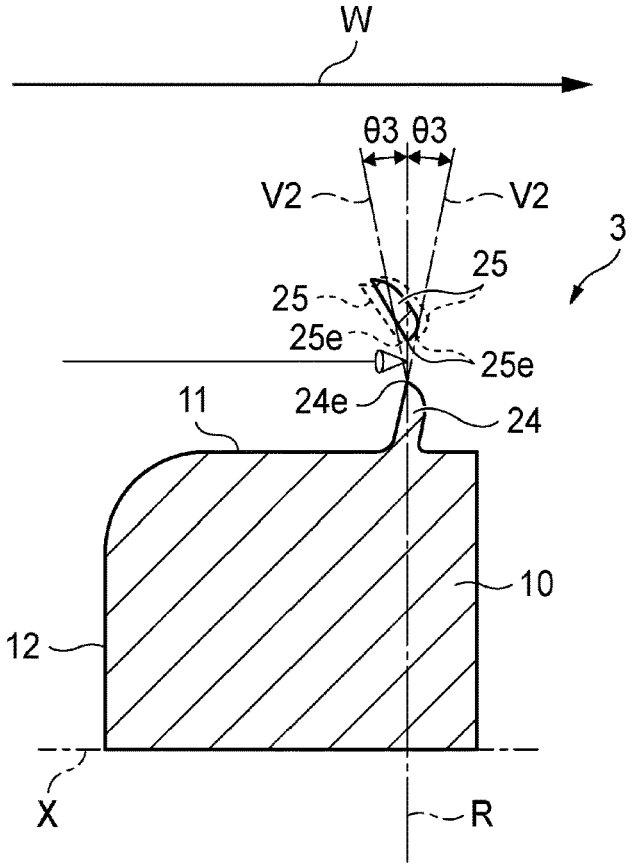
FIG. 8 is a diagram illustrating a positional relationship between the inner rear edge portion of the blade and the outer rear edge portion of the blade.

FIG. 8 illustrates the positional relationship in the air-blowing direction W between the inner rear edge portion 24 and the outer rear edge portion 25 that are provided to the rear end portion 22 of the blade 20.

FIG. 8 illustrates a cross section along the air-blowing direction W. In FIG. 8, a line linking the downstream end 24*e*, in the air-blowing direction W, of the wind receiving surface 23 of the inner rear edge portion 24 and the downstream end 25*e*, in the air-blowing direction W, of the wind receiving surface 23 of the outer rear edge portion 25 is defined as the lower end imaginary line V2. The angle that the lower end imaginary line V2 forms with a radially straight line R is defined as an intersection angle θ3, the straight line R being perpendicular to the air-blowing direction W (the direction of the axis X) and intersecting with the lower end imaginary line V2. In other words, the intersection angle θ3 represents a displacement angle indicating how much the inner rear edge portion 24 and the outer rear edge portion 25 are displaced from each other in the air-blowing direction W.

At this point in time, the intersection angle θ3 is set in such a manner as to satisfy a relationship of −5°≤intersection angle θ3≤+5°. In the embodiment, the intersection angle θ3 is desirably 0° to improve the straightness of the wind flowing in the air-blowing direction W. In other words, at this point in time, the inner rear edge portion 24 and the outer rear edge portion 25 are not displaced from each other in the air-blowing direction W.

For example, even if the intersection angle θ3 is not 0°, it is possible to improve the straightness of the wind by setting the inner inclination angle θ1 and the outer inclination angle θ2 as appropriate in accordance with the value of the intersection angle θ3. Specifically, if the intersection angle θ3 is, for example, −2°, in other words if the outer rear edge portion 25 is provided upstream of the inner rear edge portion 24 in the rotation direction F, the wind that is sent from downstream in the rotation direction of the blade 20 to downstream in the air-blowing direction is sent as the flow that inclines outward in the radial direction. In this case, for example, the inner inclination angle θ1 of the inner rear edge portion 24 is increased to enable improving the straightness of the wind by inclining the flow inward in the radial direction.

As described above, the axial fan 1 of the embodiment includes: the motor 4; the impeller 3 configured in such a manner as to be rotated by the motor 4 and send a wind (air) in the air-blowing direction W; and the casing 2 having the wind tunnel 6 along the air-blowing direction W. The impeller 3 includes the cup-shaped base 10 that covers the motor 4, and the plurality of blades 20 mounted on the outer peripheral surface of the base 10. The underside portion 12 of the base 10 is located upstream in the air-blowing direction W. In cross section along the air-blowing direction W, the outer peripheral edge 12*a* of the underside portion 12 is chamfered. The wind receiving surface 23 of the blade 20 that is located upstream in the air-blowing direction W is formed in such a manner as to include the concave portion recessed toward the downstream side in the air-blowing direction W. When the joint imaginary line V1 perpendicular to the air-blowing direction W is drawn in the radial direction from the joint position 23*j* of the blade 20 where the wind receiving surface 23 of the blade 20 and the outer peripheral surface of the base 10 merge, the bottom point 23*b* of the concave portion of the wind receiving surface 23 is located downstream of the joint imaginary line V1 in the air-blowing direction W. Furthermore, the bottom point 23*b* is displaced from inward to outward in the radial direction, in going from upstream to downstream in the air-blowing direction W until reaching the central part of the blade 20.

In a case of a fan structure where the wind from the outside flows only to the blade 20, the bottom point 23*b* on the wind receiving surface 23 of the blade 20 may be provided uniformly in the middle of the blade 20 in the radial direction from upstream to downstream in the air-blowing direction W, which enables the wind to flow uniformly. However, the wind from the outside also flows to the underside portion 12 of the base 10. The wind that has hit the underside portion 12 flows to the blade 20 along the chamfered outer peripheral edge 12*a*. Hence, the volume of air that flows to the radially inner part of the blade 20 is higher without a measure against the wind that flows from the outer peripheral edge 12*a* of the underside portion 12. The flow of this wind disturbs the distribution of the wind flowing around the blade 20 and therefore the uniform flow of the wind cannot be formed.

In contrast, the axial fan 1 of the embodiment is configured in such a manner that the position of the bottom point 23*b* of the concave portion of the wind receiving surface 23 of the blade 20 is gradually displaced from the inner side to the outer side of the blade 20 in the radial direction, in going from upstream to downstream in the air-blowing direction W, until reaching the central part of the blade 20. Hence, the wind that flows to the blade 20 from the outer peripheral edge 12*a* formed by chamfering on the underside portion 12 of the base 10 can be guided to the central part of the blade 20. Consequently, it is possible to uniform the distribution of wind in the radial direction around the blade 20. In this manner, the uniform flow of wind can be formed.

Moreover, according to the axial fan 1 of the embodiment, the blade 20 rotates in the rotation direction F about the air-blowing direction W. The blade 20 is provided in such a manner as to extend from upstream to downstream in the rotation direction F. The rear edge portion of the blade 20 in the rotation direction F branches at the turning point (for example, the rearmost end portion 22*p*) into the inner rear edge portion 24 located on the inner side in the radial direction and the outer rear edge portion 25 located on the outer side in the radial direction. The inner rear edge portion 24 inclines downstream in the air-blowing direction W, in going from the inner side to the outer side of the blade 20 in the radial direction. The outer rear edge portion 25 inclines downstream in the air-blowing direction W, in going from the outer side to the inner side of the blade 20 in the radial direction. Hence, the wind that flows over the wind receiving surface 23 of the blade 20 can be guided to the turning point of the blade 20 along the slope of the inner rear edge portion 24 and the slope of the outer rear edge portion 25. Consequently, the wind that has been guided to the turning point can be sent from the downstream side of the blade 20 in the rotation direction F to downstream in the air-blowing direction W. Hence, it is possible to improve the straightness of the flow of the wind along the air-blowing direction W.

Moreover, according to the axial fan 1 of the embodiment, in cross section along the air-blowing direction W, the lower end imaginary line V2 linking the downstream end 24*e*, in the air-blowing direction W, of the inner rear edge portion 24 and the downstream end 25*e*, in the air-blowing direction W, of the outer rear edge portion 25 intersects with the straight line extending in the radial direction in such a manner as to form an angle of ±5° or less between the lower end imaginary line V2 and the straight line. In this manner, the positions of the downstream ends 24*e* and 25*e* of the inner rear edge portion 24 and the outer rear edge portion 25 that incline downstream in the air-blowing direction W are provided at substantially the same position in the air-blowing direction W. Hence, it is possible to improve the straightness of the wind flowing from the downstream side of the blade 20 in the rotation direction F to downstream in the air-blowing direction W.

Moreover, according to the axial fan 1 of the embodiment, the inclination angle that the wind receiving surface 23 of the inner rear edge portion 24 forms with the lower end imaginary line V2 is defined as the inner inclination angle θ1. The inclination angle that the wind receiving surface 23 of the outer rear edge portion 25 forms with the lower end imaginary line V2 is defined as the outer inclination angle θ2. At this point in time, the relationship of 0°<θ1≤θ2<90° holds. In this manner, the outer inclination angle θ2 of the outer rear edge portion 25 is equal to or greater than the inner inclination angle θ1 of the inner rear edge portion 24. As a result, it is possible to guide a higher volume of the wind that flows around the radially outer side of the blade 20, to the central part of the blade 20 at the rear edge portion of the blade 20 in the rotation direction F. Consequently, it is possible to improve the straightness of the wind that flows from the downstream side of the blade 20 in the rotation direction F to downstream in the air-blowing direction W.

Figure 9:
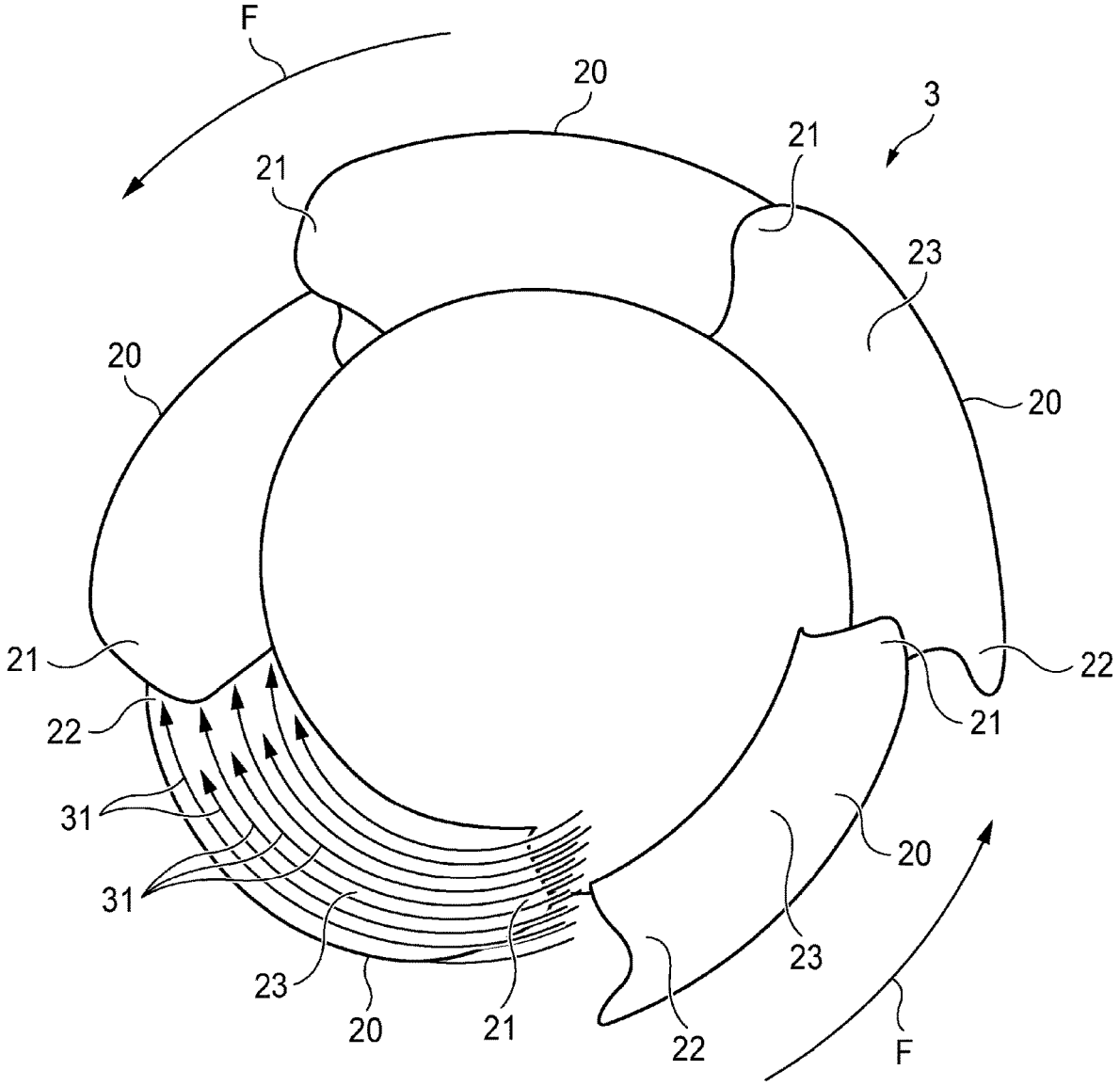
FIG. 9 is a diagram illustrating the flow of wind over the blade.

FIG. 9 schematically illustrates the flow of wind over the blade 20. In FIG. 9, the wind flowing over the wind receiving surface 23 of the blade 20 is represented by a plurality of streamlines 31. The wind that is drawn in through the inlet 5*a* with the rotation of the impeller 3 flows, in a stream of winds that are substantially uniform in the radial direction of the wind receiving surface 23, on the circumference from the front end portion 21 to the rear end portion 22 of the blade 20 in the rotation direction F as indicated by the streamlines 31. Consequently, the wind that flows downstream in the air-blowing direction W from the rear end portion 22 of the blade 20 in the rotation direction F is sent to the outlet 5*b* through the wind tunnel 6 while maintaining the straightness. In this manner, the axial fan 1 of the embodiment can improve the uniformity and straightness of the flow of wind. Consequently, the power consumption is reduced. In addition, the air flow rate can be increased.

Up to this point the embodiment has been described. However, it is needless to say that the technical scope of the embodiment should not be construed in a limited manner by the description of the above-mentioned embodiment. The above-mentioned embodiment is a mere example. Those skilled in the art understand easily that the above-mentioned embodiment can be modified in various manners within the technical scope disclosed in the description of the claims. The technical scope of the embodiment should be determined on the basis of the technical scope disclosed in the description of the claims and the scope of equivalents thereof.

The foregoing detailed description has been presented for the purposes of illustration and description. Many modifications and variations are possible in light of the above teaching. It is not intended to be exhaustive or to limit the subject matter described herein to the precise form disclosed. Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims appended hereto.

What is claimed is:

1. An axial fan comprising:

a motor;

an impeller configured to be rotated by the motor and send air in an air-blowing direction; and a casing including a wind tunnel along the air-blowing direction, wherein the impeller includes:

a cup-shaped base covering the motor; and a plurality of blades mounted on an outer peripheral surface of the base, the base includes an underside portion located upstream in the air-blowing direction, an outer peripheral edge of the underside portion is chamfered as viewed in a cross section of the impeller along the air-blowing direction, a wind receiving surface of each of the plurality of blades that is located upstream in the air-blowing direction includes a concave portion recessed toward a downstream side in the air-blowing direction, a bottom point of the concave portion of the wind receiving surface is located downstream in the air-blowing direction relative to a first imaginary line perpendicular to the air-blowing direction, the first imaginary line being drawn in a radial direction from a joint position of each of the plurality of blades where the wind receiving surface of each of the plurality of blades and the outer peripheral surface of the base merge, the bottom point is a downstream-most point in the air-blowing direction in a cross-sectional view of the impeller along the air-blowing direction, taken along a line passing through a center point of the base and extending in the radial direction, and the bottom point is displaced from inward to outward in the radial direction, in going from upstream to downstream in the air-blowing direction, until reaching a radially central part of each of the plurality of blades.

2. The axial fan according to claim 1, wherein each of the plurality of blades rotates in a rotation direction about the air-blowing direction, each of the plurality of blades extends from upstream to downstream in the rotation direction, a rear edge portion of each of the plurality of blades in the rotation direction branches at a turning point into an inner rear edge portion located on an inner side in the radial direction and an outer rear edge portion located on an outer side in the radial direction, the inner rear edge portion inclines downstream in the air-blowing direction in going from inward to outward in the radial direction, and the outer rear edge portion inclines downstream in the air-blowing direction in going from outward to inward in the radial direction.

3. The axial fan according to claim 2, wherein in the cross section of the impeller along the air-blowing direction, a second imaginary line linking a downstream end, in the air-blowing direction, of the inner rear edge portion and a downstream end, in the air-blowing direction, of the outer rear edge portion intersects with a straight line extending in the radial direction at an angle of ±5° or less.

4. The axial fan according to claim 3, wherein when an inclination angle that the wind receiving surface of the inner rear edge portion forms with the second imaginary line is defined as $\theta 1$, and an inclination angle that the outer rear edge portion forms with the second imaginary line is defined as $\theta 2$, a relationship of $0° < \theta 1 \leq \theta 2 < 90°$ holds.

* * * * *